US006192730B1

(12) United States Patent
Ames et al.

(10) Patent No.: US 6,192,730 B1
(45) Date of Patent: Feb. 27, 2001

(54) PROCESS FOR EXTRUDING A HOLLOW SECTION OR THE LIKE FROM A BILLET AND A DEVICE FOR THAT PURPOSE

(75) Inventors: Adolf Ames, Duchtlingen; Diethlem Wömpner, Bodmann, both of (DE)

(73) Assignee: Alusuisse Technology & Management Ltd., Neuhausen (CH)

( * ) Notice: Subject to any disclaimer, the term of this patent is extended or adjusted under 35 U.S.C. 154(b) by 0 days.

(21) Appl. No.: 09/397,352

(22) Filed: Sep. 16, 1999

(30) Foreign Application Priority Data

Sep. 16, 1998 (DE) ..... 198 42 291

(51) Int. Cl.[7] ..... B21C 25/04
(52) U.S. Cl. ..... 72/269; 72/468
(58) Field of Search ..... 72/269, 253.1, 72/467, 468

(56) References Cited

U.S. PATENT DOCUMENTS 5,152,163 * 10/1992 Hawkes et al. ..... 72/269
5,813,269 * 9/1998 Yano ..... 72/269

FOREIGN PATENT DOCUMENTS

2071543 * 9/1981 (GB) ..... 72/269
55-106627 * 8/1980 (JP) ..... 72/269
56-165512 * 12/1981 (JP) ..... 72/269
61-209716 * 9/1986 (JP) ..... 72/269

* cited by examiner

*Primary Examiner*—Ed Tolan
(74) *Attorney, Agent, or Firm*—Cohen, Pontani, Lieberman & Pavane

(57) ABSTRACT

A process for extruding a section or the like from a billet, in which a billet is introduced into the bore of a container and, by an extrusion stem, is fed in the direction of extrusion into a shape-forming cross-sectional opening in a die. The billet material is pressed into a central inlet in the die and the resultant ductile mass fed outwards at an angle to the direction of extrusion through a plurality of channels to the shape-forming cross-section. The main load is applied by the extrusion force acting outside the central inlet and the shape-forming region and is preferably diverted outside the shape-forming region to the supporting die parts.

11 Claims, 7 Drawing Sheets

PROCESS FOR EXTRUDING A HOLLOW SECTION OR THE LIKE FROM A BILLET AND A DEVICE FOR THAT PURPOSE

BACKGROUND OF THE INVENTION

1. Field of the Invention

The invention relates to a process for extruding a hollow section or the like from a billet which is introduced into the bore of a container and, by means of an extrusion stem, is fed in the direction of extrusion into a shape-forming cross-sectional opening in a die. Furthermore, the invention also relates to a device which is specially suited for that purpose.

2. Discussion of the Prior Art

During extrusion, a material which is in a ductile state—in the case of metals this includes materials such as non-ferrous metals, sintered metals or steel but in particular material in the form of an aluminium alloy—viz., a heated cast billet or rolled bar of material, is pressed in the direction of extrusion by an extrusion stem—or in the case of hydrostatic extrusion, by means of a fluid—out of a container through one or more shape-forming openings in a die. In the case of direct or forward extrusion the stem moves in the direction of the die opening, in the same direction as the resultant section. In indirect or backward extrusion the material is moved in the direction counter to that of the stem, through a die which is mounted on the hollow stem.

To produce hollow sections, so called hollow dies with a die plate are employed in the extrusion process, an example of this is described in DE 24 46 308 Al. The die plate is integrated in a part of the mandrel to provide the outer contour of the resultant section. In that case, in order to shape the inner contour, a mandrel—in the case of multi-chamber sections a plurality of mandrels—is arranged such that the mandrel projects into the die plate and beyond the shape-forming region. In such a process the ductile material is guided over inlets and into the extrusion tool in such a manner that the strands from the individual inlets flow together again under mandrel support arms—into a welding chamber—where they are welded together again. As the extrusion process proceeds further, the material or the aluminium alloy flows past the mandrel and the die opening, thereby adopting the prescribed hollow section shape. The inlets are always situated outside around the hollow space or spaces in the section; the aluminium alloy is introduced into the shape-forming region of the die from the outside, in particular via a plurality of inlets. If in the case of multi-chamber dies the inner regions of the hollow section can not be adequately supplied with metal from outside, then additional feeding inlets are provided in the inner part of the hollow section.

The main supply inlets are always situated around the outer contour of the hollow space in the section.

The size of hollow section that can be manufactured i.e. its maximum diameter of circumscribing circle is limited therefore by the diameter of the container and the size of the inlets arranged around the hollow space as well as the strength of the above mentioned mandrel support arms.

In general, the maximum section size that can be manufactured on conventional extrusion presses is limited by the size of the extrusion press, the diameter of the container used and the strength of the extrusion die. The above mentioned patent DE 24 46 308 and patent DE 28 12 690 of the applicant are concerned with the dimensioning of the latter for hollow section manufacture using large mandrel surface area. Also, the quality of the extrusion weld is influenced by the outer edge zone of the extrusion billet flowing into the outer inlets in the extrusion die, with the result that it is possibly necessary to machine away the outer skin of the billet before use. Furthermore, the shaping capacity and the service life of the extrusion tool are considerably reduced by the high load on the mandrel surface, by creep resulting from this high load, and by bending.

Attention must also be given to the fact that metal billets, especially billets of aluminium alloys, are covered with contaminants—for example residual lubricant—and with an oxide layer. In particular, oxide particles on the end and outer surface of the ingot may be extremely detrimental with respect to the structure of the section; the resultant zone of contaminating inclusions in the section is relatively long—depending on the shape of the section and the extrusion speed. Consequently, with increasing quality requirements, manufacturers are forced to scrap increasingly longer lengths of section. The result is diminished output and lower cost efficiency due to diminishing yield of section length.

SUMMARY OF THE INVENTION

In view of the above, the object of the present invention is to enable section widths to be manufactured with maximum independence on extrusion press geometry. In addition, contaminated regions which arise during extrusion, in particular extrusion of aluminium alloys, should be prevented.

According to the invention the billet material is introduced under pressure into a central inlet in the shape-forming die and the resultant ductile mass fed outwards at an angle to the direction of extrusion through a plurality of channels to the shape-forming section. The extrudate therefore no longer reaches the shape-forming region via inlets arranged around the hollow section, but instead is fed through a central inlet opening in the interior of the space in the hollow section. The extrudate flows according to the invention from this central inlet, out via the radial, outward inclined channels of a large welding chamber into the shape-forming region.

The diameter of the circumscribing circle of the section to be manufactured may be significantly larger than the diameter of the container.

Also within the scope of the invention is a device for extruding a hollow section or the like from a billet which is introduced into the bore of a container and is fed by means of an extrusion stem in the direction of extrusion to a shape-forming cross-sectional opening in the die, whereby from the inlet side of the die an approximately central inlet is provided within the hollow space of the section. From the wall of that inlet a plurality of arm-like channels branches out at an angle of preferably more than 90° to the die end face; joining up to these is the shape-forming cross-sectional opening which is preceded by a welding chamber.

In the case of rotationally symmetrical sections, the central inlet is preferably in the centre of the die. In the case of irregularly shaped sections the centre of gravity of the area of the inlet is situated as close as possible to the centre of gravity of the section or in the middle of the die—or in another suitable region of the hollow space in the section.

If hollow sections with large side-length ratios or asymmetric shape have to be produced, then the necessary amount of metal feed is achieved by means of a further feature according to the invention viz., via at least two of the described central inlets which form the respective central inlet element for the channels running at an angle out of them.

In the case of certain extrusion cross-sections it may be necessary in special cases to provide, in addition to the central inlet, material feed channels also outside the central inlet or hollow section space, this in order to feed particular parts of the section. In all of these special cases the so-called central inlet also serves as the main inlet; these metal feed channels are simply supplementary.

The production of round tubes of different diameter and wall thickness may be performed using basic central inlet dies in which, advantageously, mandrel rings of different outer diameter and die plates of different internal diameter are provided in predetermined cross-sectional regions.

One of the advantages achieved by the procedure according to the invention is that the size of the section that can be produced is not limited in its geometry by the size of the extrusion press and diameter of the container. Tubes or hollow sections of large circumscribing circles can also be manufactured using small diameter containers on extrusion presses having relatively small extrusion force as the amounts of extrudate necessary for deformation can be fed to the shape determining zone via central inlets of small cross-section—i.e. openings of small diameter. It is therefore possible to manufacture sections with small cross-sectional area and large diameter of circumscribing circle also using materials that are difficult to shape, and to do so using small containers and high specific pressure; as a result the spectrum of cross-sections that can be produced is greatly increased.

Of particular importance is that the material is always fed to the die from the middle of the billet and is not spread out to the shape-forming region of the die until in the die itself. Extrudate from the contaminated outer region of billet can not flow into the die. The material from the contaminated outer edge zone is collected in the ingot butt and sheared off at the end of the extrusion stroke. As a result, using the die according to the invention it is basically no longer necessary to machine away the outer region of the billet—as may be necessary when extruding large cross-sections in old extrusion presses.

The load acting on the die is much lower in the region which is important for shaping the section viz., in the mandrel interior; this because the load is applied only over the cross-sectional opening of the central inlet, and not as in the case with conventional dies over the whole cross-sectional surface on the section hollow spaces projected on the die inlet side.

The main load applied to the cross-section of the billet to be extruded occurs in the die region outside the central inlet or inlets. This load may be taken up by the outer region of the die, i.e. not the shape-forming region—or by the die support parts.

The low load on the die in the process according to the invention results in accurately dimensioned extruded sections over a longer service life of the die, or for the same service life permits the production of lighter section cross-sections or such using materials that are difficult to extrude.

BRIEF DESCRIPTION OF THE DRAWINGS

Further advantages, features and details of the invention are revealed in the following description of preferred exemplified embodiments and with the aid of the drawing which shows in FIG. 1: a perspective view of part of an extrusion press with horizontal stem.

DETAILED DESCRIPTION OF THE PREFERRED EMBODIMENTS

Figure 1:
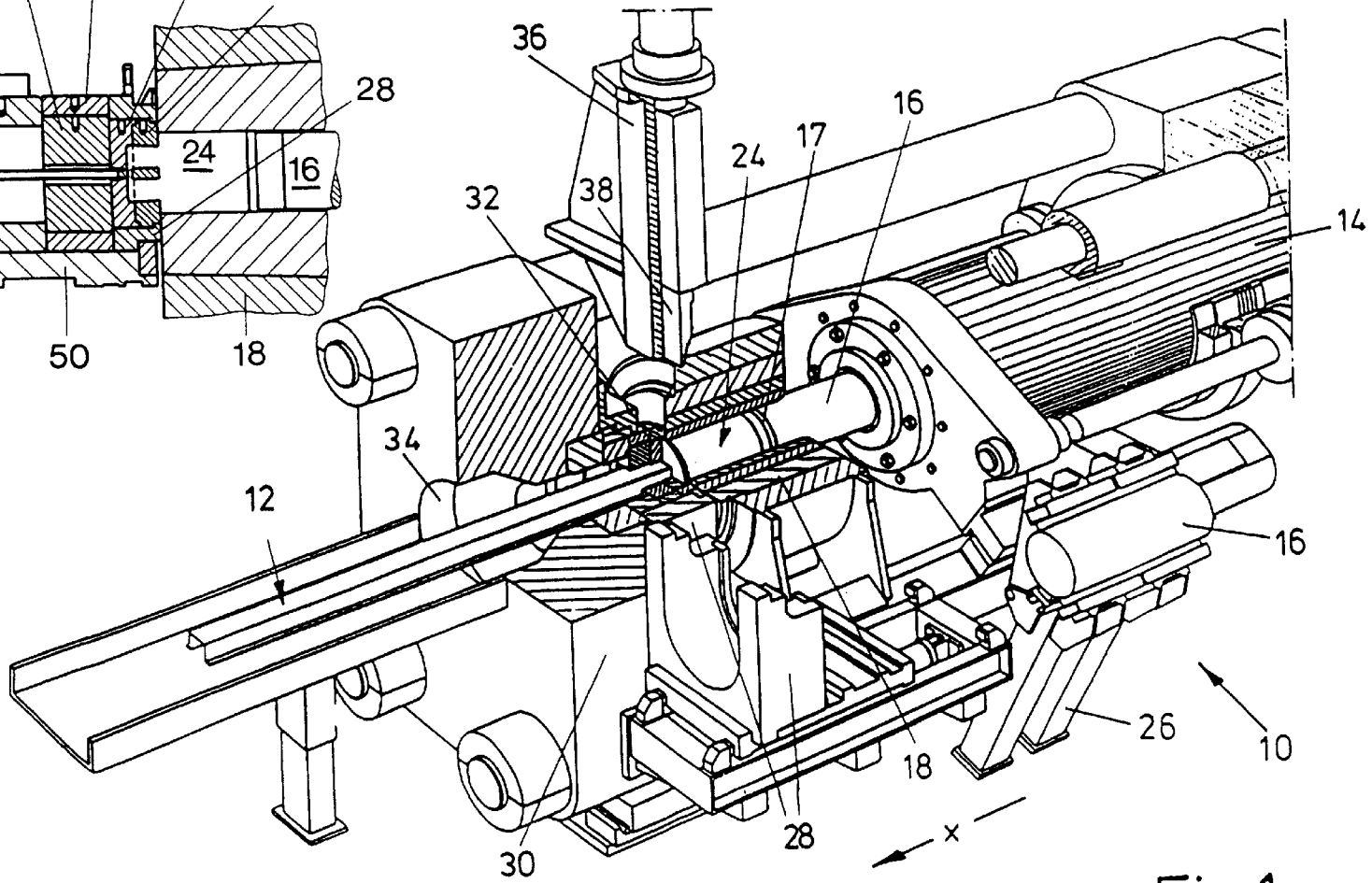

An extrusion press 10 for direct extrusion of sections 12 features, as shown in FIG. 1, on a main cylinder 14, an extrusion stem 16 which lies along the longitudinal axis A of the bore 19 of a recipient or container 18. The diameter d of a dummy block 17 at the free end face of the stem 16 is slightly smaller than the free bore diameter $d_1$ with the result that the stem 16 is able to penetrate the container bore 19. The mentioned free bore diameter $d_1$ is delimited by the inner surface 20 of a sleeve 21 inserted in the container 18 or its bore 19. In the following the space inside this sleeve 21 is called the container bore 22.

The maximum distance between the front 23 of the container 18 and the dummy block 17 in the inactive position of the stem 16—which is not shown here—is such that a billet or ingot 24 of light weight metal, in particular preheated aluminium alloy, can be aligned by means of a loader 26 in front of the container bore 22 and pushed by the stem 16 in the direction of extrusion x into the container bore 22.

Close to a container end face $\mathbf{23}_a$, remote from the stem 16, is the shape-forming die 32 resting in a die holder 28 on an extrusion platen 30. With respect to the direction of extrusion x this is followed by a run-out channel 34 in the platen 30 through which the resulting section 12—having the shape endowed by the contour of the die 32—is removed. Above the container 18 is, as shown in FIG. 1, a jacking system 36 for a shearing tool 38 which moves radially to a gap 40 between the container 18 and the die 32.

Figure 2:
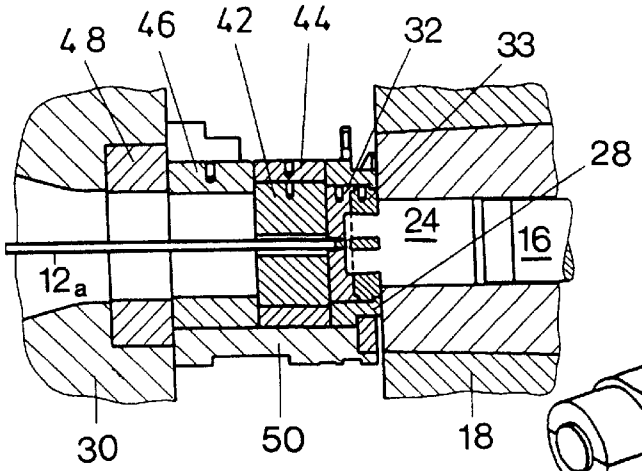
FIG. 2: a sectioned view of part of another extrusion press enlarged with a respect to FIG. 1.
Figure 3:
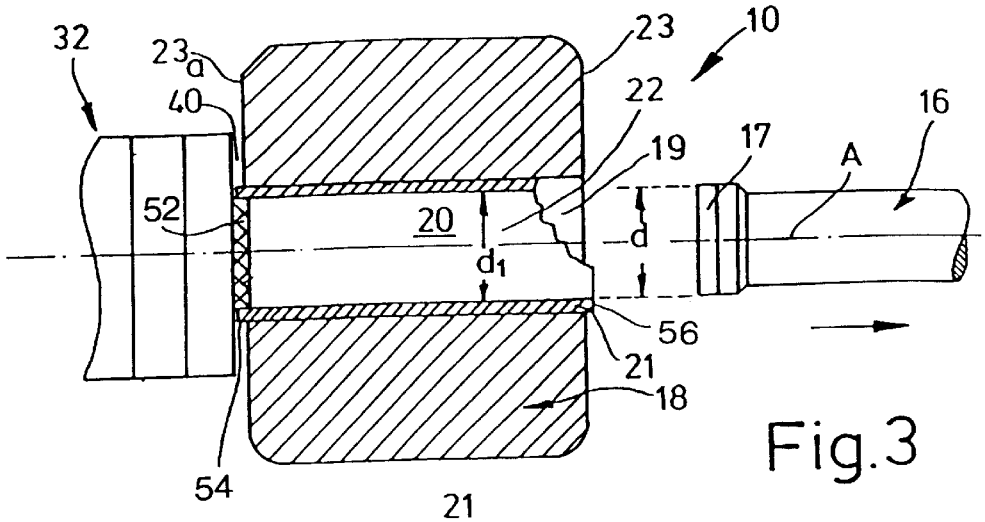
FIG. 3: a schematic epresentation of a longitudinal section through a container of the extrusion press with stem followed, in the direction of extrusion, by a die.
Figure 4:
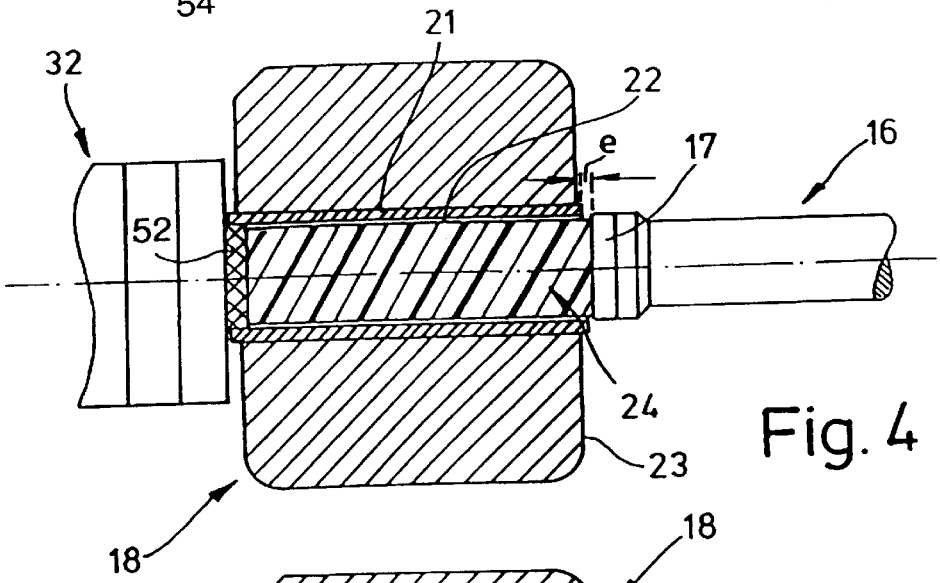
FIG. 4, 5, 6: the representation shown in FIG. 3 but with container and stem in different positions.

In the example shown in FIG. 2, a mandrel part 33 is provided between the container 18 and the plate-shaped die 32, this for the purpose of creating the inner contour of a resultant section $\mathbf{12}_a$. The die plate lies—in the direction of extrusion x—immediately downstream of a bolster plate 42 in a bolster plate holder 44. A ring-shaped collar 46 is situated adjacent to the bolster plate 42 followed by a closing ring 48 in the platen 30. A die container 50 is provided for the die holder 28, the bolster plate 44 holder and the ring-shaped collar 46.

At the end of the extrusion process a so-called butt 52, from which the dummy block 17 has already separated, forms on the facing die surface at the end of the container bore 22 away from the stem 16. As a result of a collar 54 of oversize h on the container sleeve 21, that tool face remains a distance from the front end $\mathbf{23}_a$ of the container. Also at the front container end 23 the container bore 22 surrounds a ring-shaped collar 56 which provides a projecting length of the container sleeve 21.

On inserting a new billet 24, the free end of the butt 52 is e.g. about 80 mm thick. The back end distance e of ingot material amounts to at most 20 mm.

Figure 5:
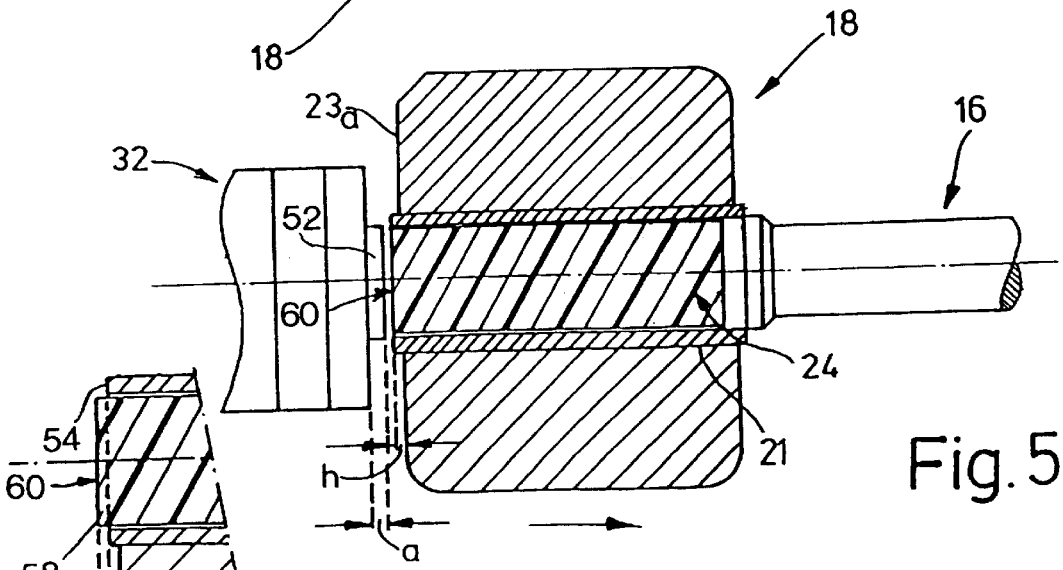
Figure 6:
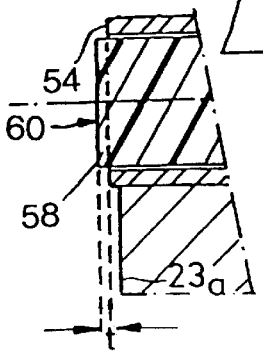

The container 18 is then drawn back—e.g. somewhat more than 450 mm—until the butt 52 is standing free (FIG. 5). If the billet 24, as shown in FIG. 6, projects out a collar length t of about 10 mm beyond the collar 54, then the billet 24 is compressed by the stem 16; it should then not be possible for the billet 24 to be displaced by the shearing tool 38 as a result of a subsequent shearing step. Before the shearing process takes place, the container 18 is drawn counter to the direction of extrusion x until the rear face of the shaping tool or die 32 is a distance from the end face $\mathbf{23}_a$ of the container 18. The container 18 and the die 32 are temporarily fixed in this position.

By lowering a shearing blade of the shearing tool 38—shown in FIG. 1—the butt 52 or an end slice 58 of the projecting length t of billet 24 is removed, and with that the end face 60 of the billet 24 facing in the direction of extrusion x. Prior to the mentioned shearing operation an oxide layer forms at the end face 60, which oxide particles would create undesirable impurities in the resultant section 12. By removing the end slice 58 along with the end face 60 of the billet a billet end free of the oxide layer is obtained.

After the shearing operation the container 18 is again moved towards the die 32 and the extrusion process can begin again from the start.

Figure 8:
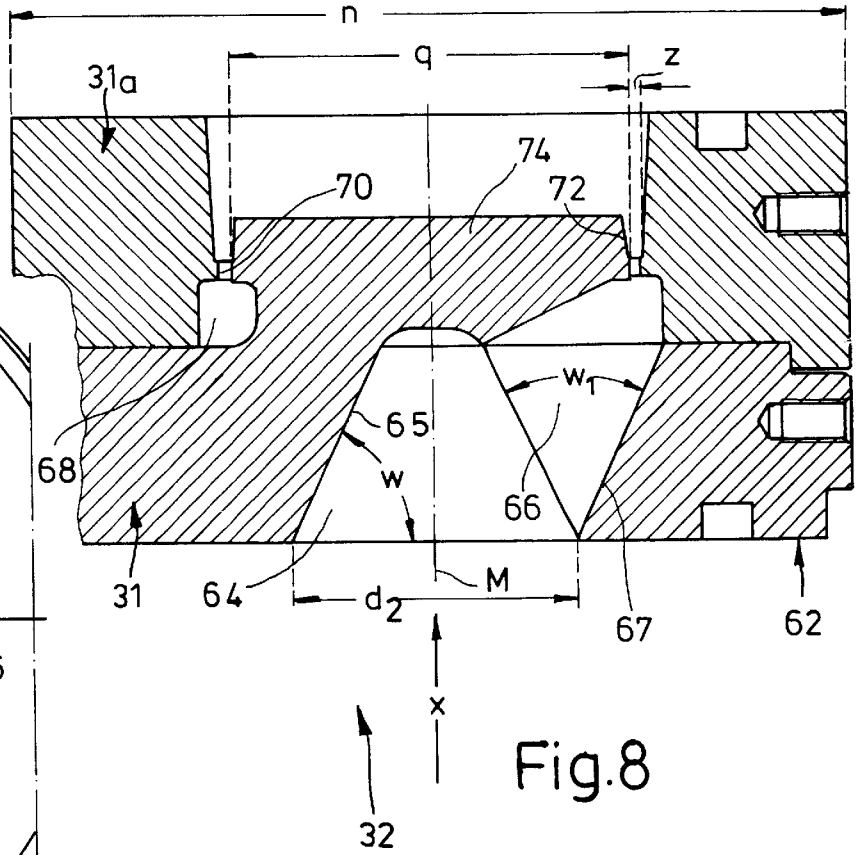
FIG. 8, 10, 12, 14: cross-sections through FIG. 7 along line VIII—VIII, through FIG. 9 along X—X, through FIG. 11 along XII—XII and through FIG. 13 along XIV—XIV
Figure 7:
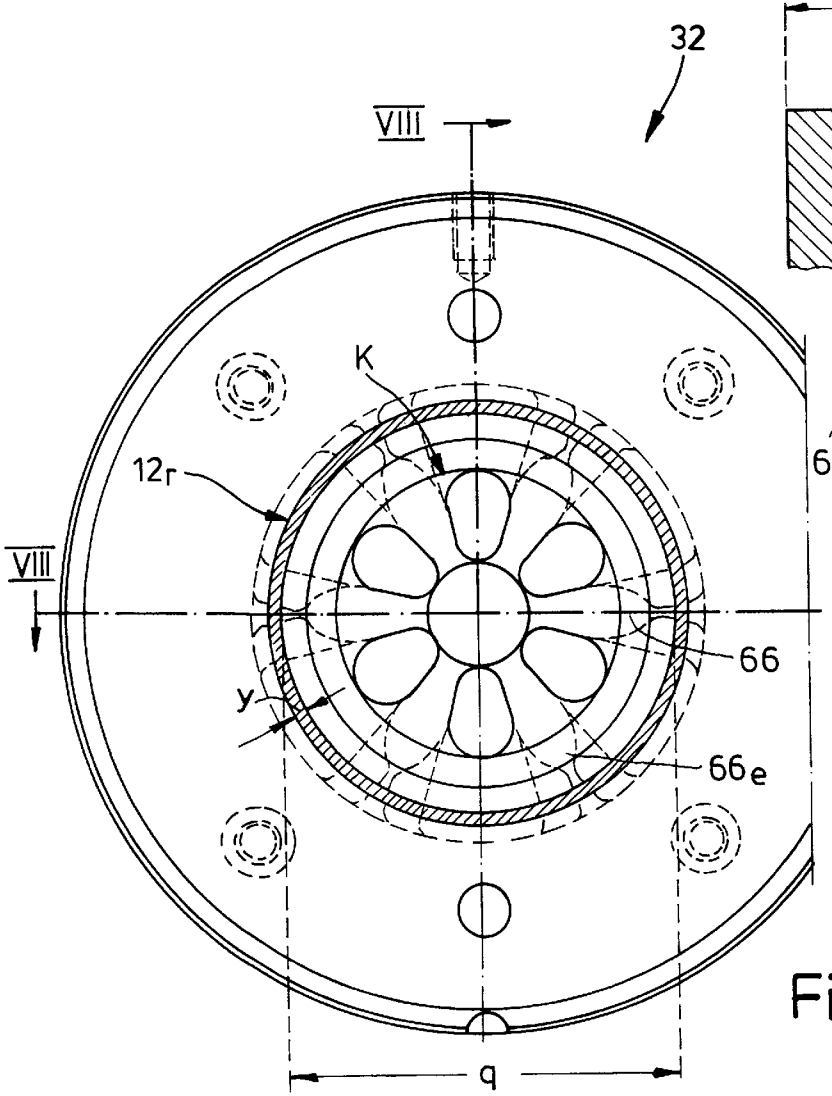
FIG. 7, 9, 11, 13: schematic end views of various, different extrusion dies.

FIGS. 7, 8 show a plate-shaped forming tool or die 32 of diameter n—equal here to approx. 500 mm—comprising two die parts 31, $\mathbf{31}_a$ for the purpose of manufacturing a rotationally symmetrical tube 12 or the like hollow section of circular cross-section of inner diameter q, here 236 mm in magnitude. As viewed in the direction of extrusion x a so called central inlet 64 which is shaped as a blunted-cone, is provided in the mandrel or die part 31 in the end 62 of the die facing the mandrel. The die axis M forms thereby the axis of symmetry; the diameter $d_2$ of its inlet contour K measures 170 mm. Branching out from the inlet wall 65, which runs at an angle w—here 65°—from the end face 62 of the die, are arm-like channels 66 the outer channel contour 67 of which in this section runs approximately parallel to the diametrically distant contour of the inlet wall 65 to form an angle $w_1$ with the other visible neighbouring contour of the inlet wall 65—here an angle of 50°. These channels 66—tapering in the plan view shown in FIG. 7 ultimately to dome-like end section $\mathbf{66}_e$—terminate in the direction of extrusion x in a ring-shaped welding chamber 68 which is followed by a circular shaping cross-section 70 of width z for the corresponding wall thickness of the tube $\mathbf{12}_a$. The shaping cross-section 70 is limited on the inside by the surface 72—here ring-shaped—of a mandrel projection 74.

The extrudate is therefore not—as is normally the case—fed to the shaping region through a plurality of inlets situated outside around the hollow section or tube 12, but instead only via that central inlet 64. During the subsequent extrusion process the extrudate is fed via the radially inclined channels 66 out of the central inlet 64 outwards to the welding chamber 68 and to the shape-giving cross-section 70.

In the case of irregular shaped sections the areal centre of gravity of the inlet is situated as close as possible to the centre of gravity by mass of the section or in the middle M of the die—or in another suitable region of the section hollow space.

Figure 10:
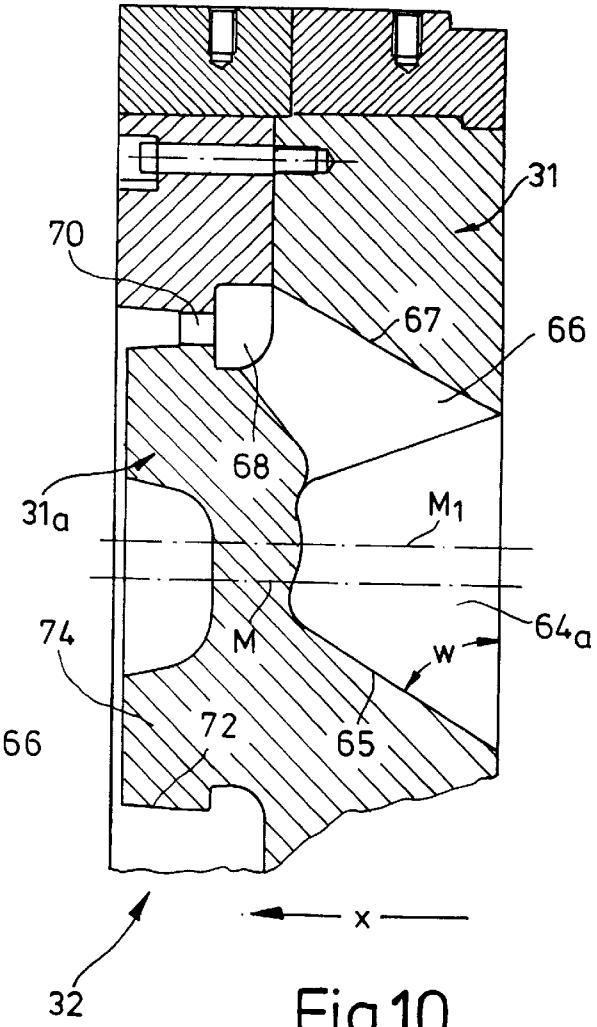
Figure 9:
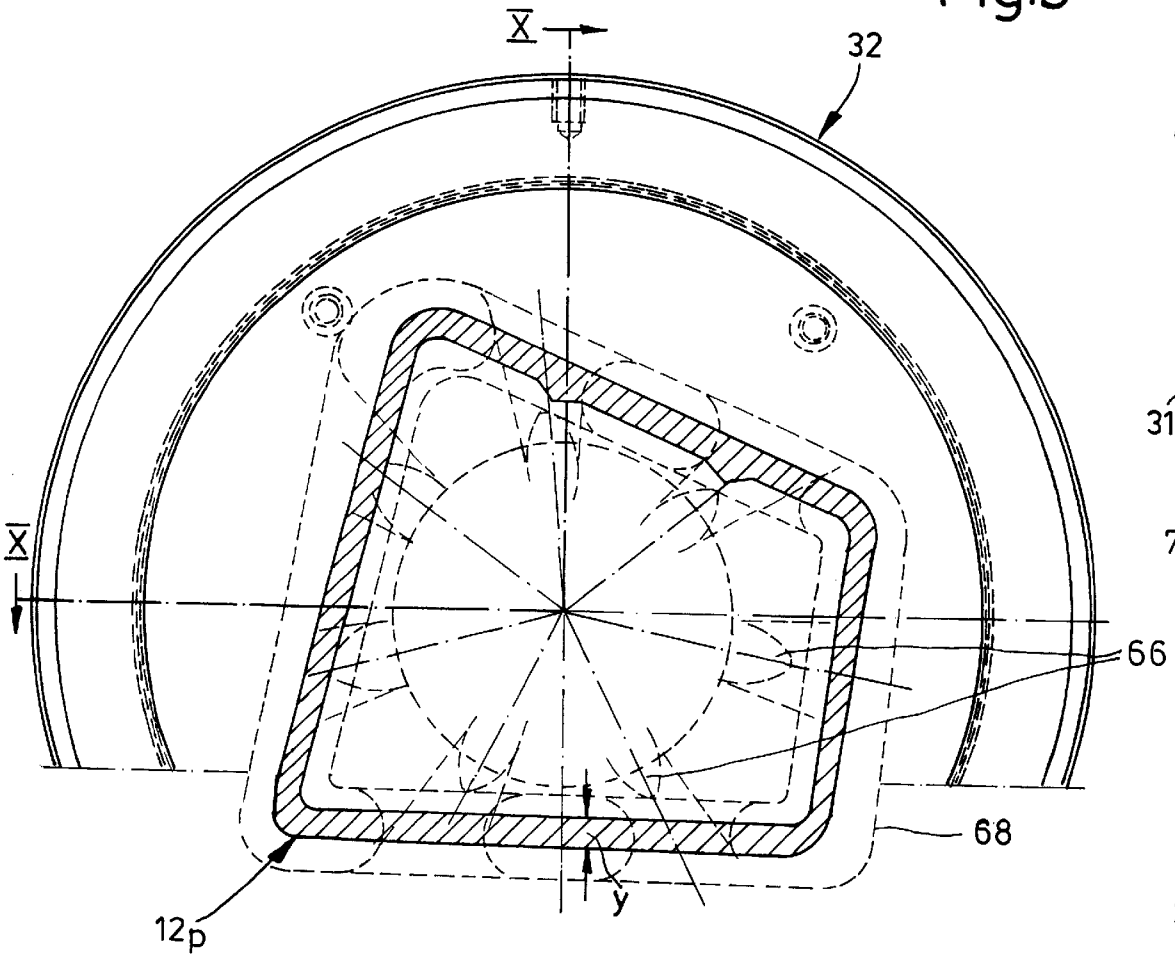
Figure 12:
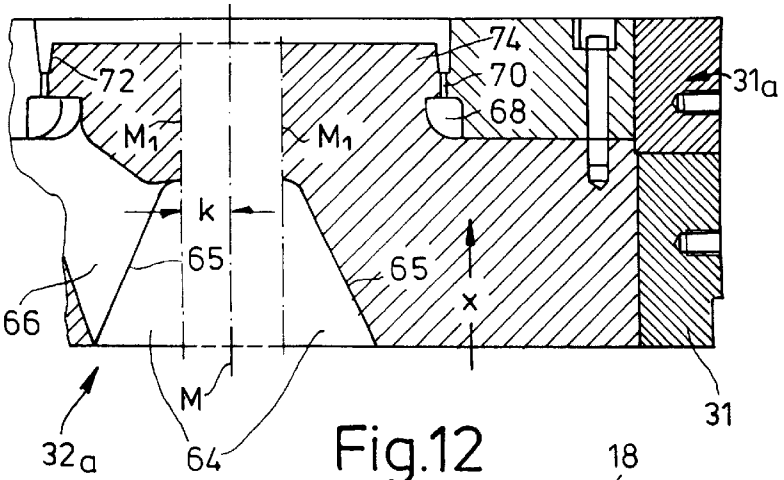
Figure 11:
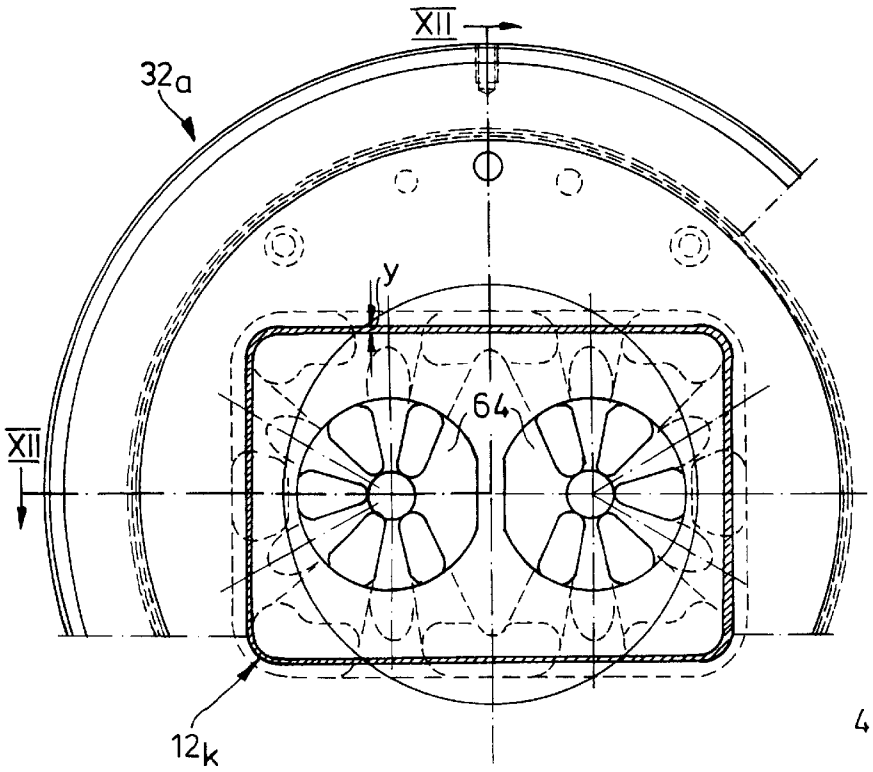
Figure 14:
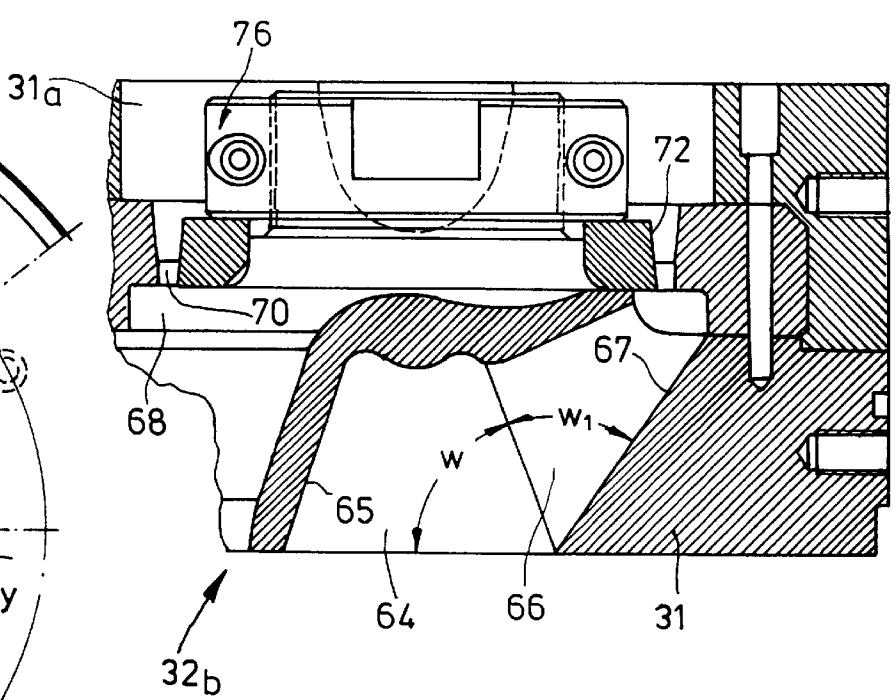
Figure 13:
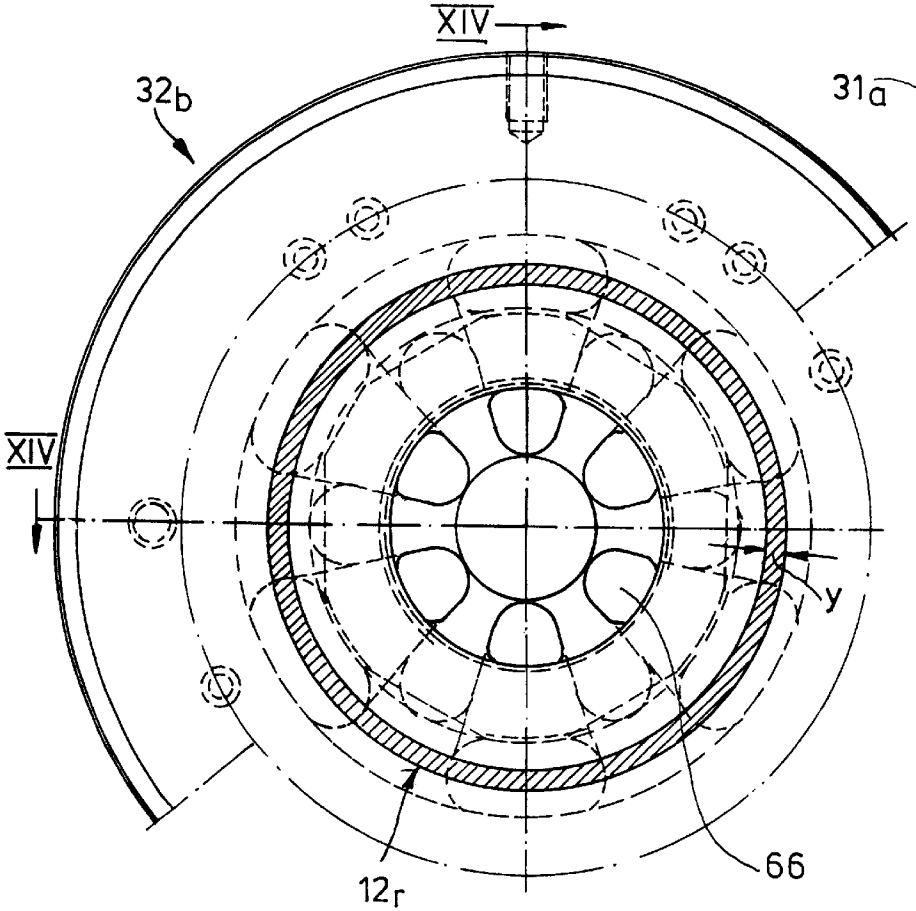

As shown in FIGS. 9 and 10 hollow sections $\mathbf{12}_p$ may also be created with a polygonal or asymmetric cross-section using a central inlet $\mathbf{64}_a$. The inlet wall 65, shown in FIG. 10, creates an asymmetric cross-section i.e. the die axis M lies outside the inlet axis $M_1$. With such asymmetric section shapes or hollow sections $\mathbf{12}_p$ or $\mathbf{12}_k$ with large side length ratios, the necessary amounts of material can be fed via at least two of the described central inlets 64, as indicated in the die shown in FIGS. 11 and 12. There the central axes $M_1$ of the central inlets 64 run a radial distance k from the die axis M.

The production of round tubes 12 of different diameter q and wall thickness y can be performed using dies $\mathbf{32}_a$ in which mandrel rings 76 of different outer diameter and die plates $\mathbf{31}_a$ of different inner diameter are employed in predetermined cross-sectional regions.

Figure 15:
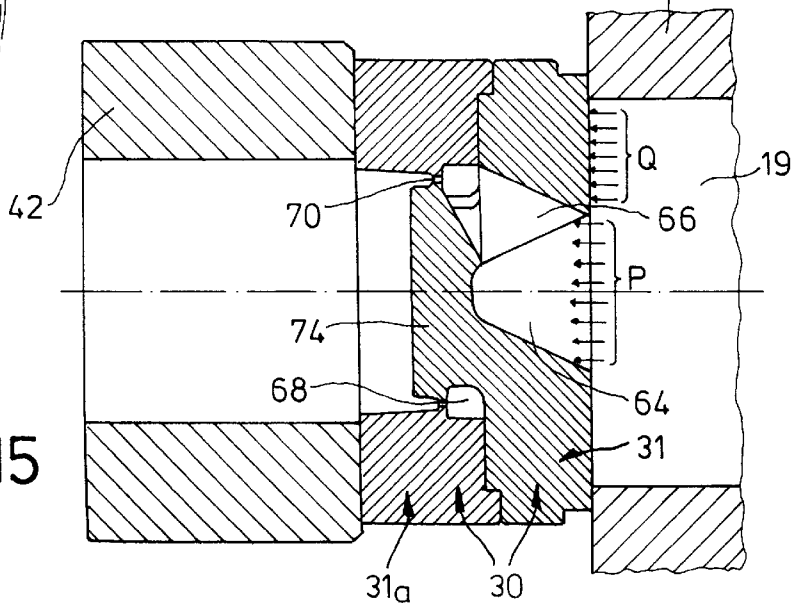
FIG. 15: a longitudinal section through a shape-forming die showing the influence of load thereon.

In FIG. 15 it can be seen that the load P on the die is much lower in that region which is important for creating the section viz., in the interior of the mandrel part 31, this is because the load is created only over the cross-sectional opening of the central inlet 64 and not—as in conventional dies—over the whole cross-sectional surface of the section hollow space areas projected onto the die inlet side 62.

The main load over the cross-section of the billet to be extruded takes place in the die area outside the central inlet or inlets 64. This load can, as indicated by the arrows Q, be borne in the outer region of the die 30—i.e. not in the shaping region—by the die support parts.

Figure 16:
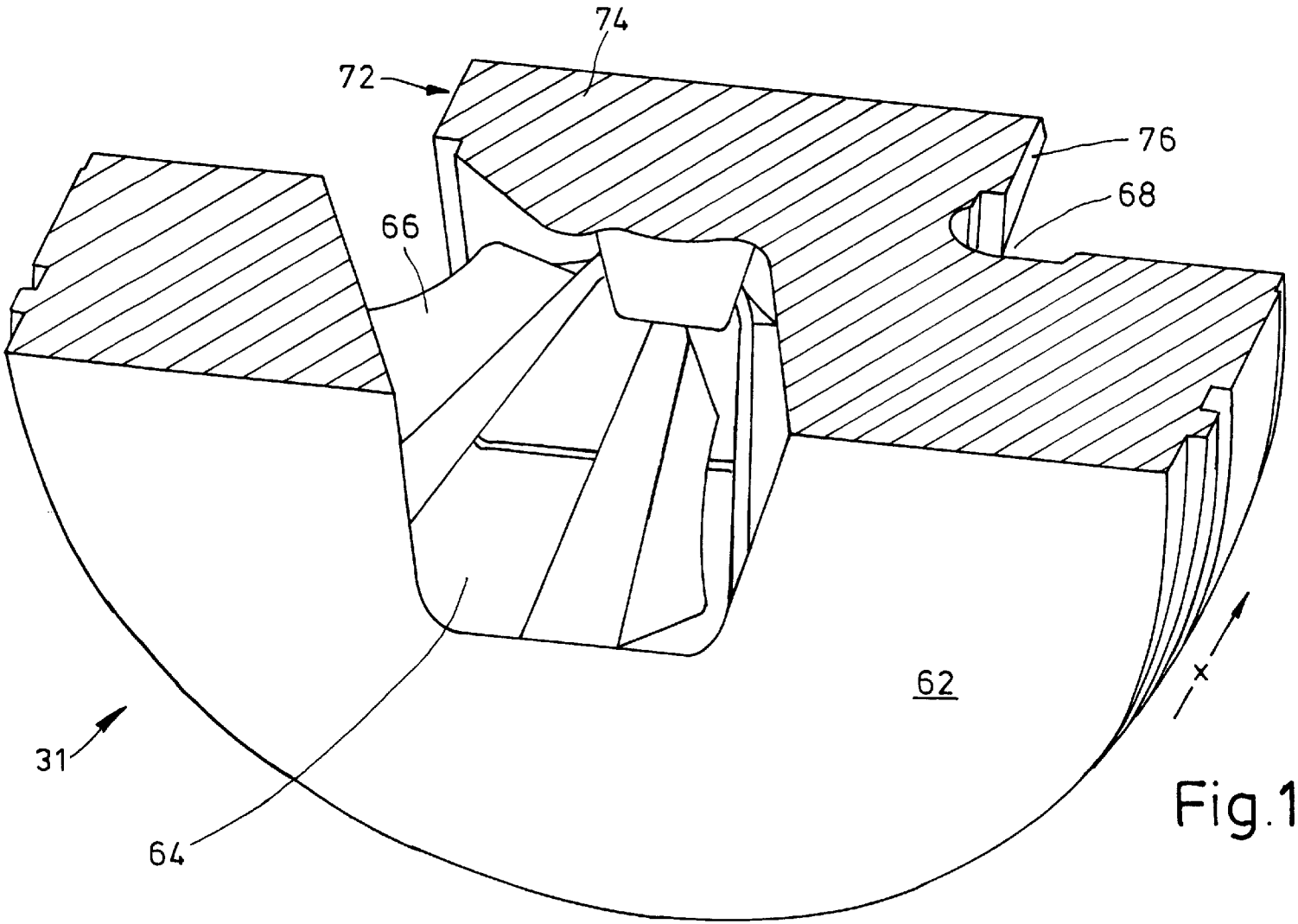
FIG. 16 a perspective view through a partially sectioned die.

The perspective view in FIG. 16 of a mandrel part 31 of a die 32 shows clearly its make up with the central inlet 64, the subsequent channels 66 and a plate-shaped mandrel projection 74 which projects out at the central axis of the die and determines the inner surface of the section and with that also the inner limit 72 of the shape-forming opening 70.

What is claimed is:

1. A process for extruding a hollow section from a billet, comprising the steps of:

introducing the billet into a bore of a container; and feeding the billet in an extrusion direction into a shape-forming opening in a die, the feeding step including pressing the billet material into at least two neighboring central inlets in the die which are respective central inlet elements for channels running out from the inlets, the central inlets being within an extension to a hollow space in a forming section, and feeding a resultant ductile mass outwards at an angle to the direction of extrusion through a plurality of channels to the shape-forming cross-section of the die so that the material is always fed to the die from a middle of the billet and is not spread out to the shape-forming region of the die until the material is in the die itself.

2. A process according to claim 1, including applying a main load by an extrusion force acting outside the central inlets and the shape-forming region.

3. A process according to claim 2, including diverting the main load by the extrusion force acting outside the shape-forming region to die supporting parts.

4. A process according to claim 1, including extruding sections having a much larger diameter of circumscribing circle than a diameter of the container.

5. A device for extruding a hollow section from a billet, comprising:

a container having a bore;

a die having a shape-forming cross-section from a billet; and an extrusion item operatively arranged to press the billet into the container bore in an extrusion direction into the shape-forming cross-section of the die, the die having an inlet end with at least two neighboring inlets that are respective central inlet elements for channels running out from the inlets, the central inlets being within an extension to a hollow space in the forming section so that billet material is always fed to the die from a middle of the billet and is not spread out to the shape-forming section of the die until the material is in the die itself.

6. A device according to claim 5, wherein a plurality of arm-like channels run from a wall of the central inlet at an angle of more than 90° to an end face of the inlet end of the die, the channels being followed by a welding chamber which in turn connects to the shape-forming cross-section.

7. A device according to claim 5, wherein the inlet is situated approximately along a middle axis of the die so as to produce a rotationally symmetric section.

8. A device according to claim 5, wherein the inlet is situated at approximately one of at a center of gravity according to section mass and at a middle of the die, for producing an irregularly contoured section.

9. A device according to claim 8, wherein the die axis lies outside the axis of the inlet.

10. A device according to claim 5, wherein the inlets have central axes that run a radial distance from a central axis of the die.

11. A device according to claim 5, wherein the die has exchangeable mandrel rings of different outer diameter and die plates of different inner diameter.

* * * * *